United States Patent [19]

Hirose et al.

[11] 4,236,811

[45] Dec. 2, 1980

[54] ELECTROPHOTOGRAPHIC COPYING APPARATUS

[75] Inventors: Akira Hirose, Tokyo; Keiji Sugita, Yokohama; Yasuzi Takagi, Matsudo, all of Japan

[73] Assignee: Ricoh Company, Ltd., Japan

[21] Appl. No.: 973,802

[22] Filed: Dec. 28, 1978

[30] Foreign Application Priority Data

Jan. 7, 1978 [JP] Japan ..... 53-618

[51] Int. Cl.[3] ..... G03G 15/00

[52] U.S. Cl. ..... 355/14 R; 355/3 CH

[58] Field of Search ..... 355/3 R, 7, 14 R, 75, 355/3 CH

[56] References Cited

U.S. PATENT DOCUMENTS

| | | | |
|---|---|---|---|
| 3,062,110 | 11/1962 | Shepardson et al. | 355/11 |
| 3,792,913 | 2/1974 | Simmons | 355/7 |
| 3,901,593 | 8/1975 | Kogiso et al. | 355/11 |
| 3,960,446 | 6/1976 | Ogawa et al. | 355/13 |
| 4,008,954 | 2/1977 | Ogawa et al. | 355/1 |

FOREIGN PATENT DOCUMENTS

| | | | |
|---|---|---|---|
| 2415390 | 10/1974 | Fed. Rep. of Germany | 355/3 R |
| 1443371 | 7/1976 | United Kingdom | 355/14 |

*Primary Examiner*—Richard L. Moses

*Attorney, Agent, or Firm*—McGlew and Tuttle

[57] ABSTRACT

An electrophotographic copying device comprising a quenching apparatus capable of quenching the unnecessary charges an a non-image area of a photoconductor prior to development of an image regardless of the position of a pressure plate for holding an original document on a contact glass of the electrophotographic copying apparatus. The quenching apparatus can also be used with an electrophotographic copying machine capable of reducing the copy size.

2 Claims, 8 Drawing Figures

ELECTROPHOTOGRAPHIC COPYING APPARATUS

BACKGROUND OF THE INVENTION

The present invention relates to an electrophotographic copying machine capable of quenching unnecessary charges on a non-image area of a photoconductor prior to development of an image thereon.

In the conventional electrophotographic copying machine, the photoconductor is charged uniformly and exposed to a light image and the light image is then developed. At this time, since a non-image area on the photoconductor is not exposed completely, some charges remain on the non-image area, and when the non-image area passes through a development section, toner is attracted to the non image area, which causes wasting of toner and a trouble of the necessity of cleaning the toner deposited on the photoconductor.

Therefore, conventionally, the following quenching systems are proposed. In the first quenching system, between an exposure section and a development section, there is disposed a quenching lamp, whose actuation is controlled in accordance with the timing of the movement of the photoconductor or the timing of exposure, whereby unnecessary charges in the areas before and behind an image area are quenched. However, the unnecessary charges existing in the direction normal to the removement of the photoconductor cannot be quenched.

Therefore, by disposing a plurality of lamps spaced in accordance with the size of an original or the size of a transfer sheet in the direction normal to the movement of the photoconductor, the unnecessary charges are removed. This apparatus is continuously in operation during the copying process. Another known quenching apparatus comprises plural light receiving elements extending in the direction normal to a movement of the photoconductor, which are disposed in the path of light rays which are projected to the exposure section, and the same number of light emitting element as that of the light receiving elements, which are disposed so as to face the surface of the photoconductor. This apparatus is to detect an unexposed area on the photoconductor by the light receiving elements, whereby the quenching lamp is controlled. However, this apparatus is complicated in its mechanism and high in cost.

The second conventional quenching system is comparatively simple in mechanism and works effectively. However, it has the following shortcomings. Namely, in the ordinary electrophotographic copying machine, there is provided a pressure plate having an irregular reflection surface which is white in color on a side thereof facing a contact glass of the electrophotographic copying machine. In order to obtain copies from an original which is smaller in size than a maximum copy size that can be obtained by the copying machine, light from the area outside the original is reflected from the white surface of the pressure plate and reaches the surface of the photoconductor. Therefore, the unnecessary charges in the area outside the image area on the photoconductor can be quenched to some extent without a particular quenching apparatus. However, when copying is performed from a thick original document, the pressure plate is held open or away from the contact glass by the thick original document, so that a sufficient amount of light is not reflected from the pressure plate and accordingly a sufficient amount of light does not reach the photoconductor. Furthermore, there is a risk that the unnecessary charges in the non-image area cannot be removed since copying is performed with the pressure plate opened. Therefore, the unnecessary charges on the photoconductor are removed prior to development by a quenching apparatus. The unnecessary charges in the non-image area can be surely removed by the quenching apparatus. However, in case light reflected from the closed pressure plate reaches the photoconductor, the non-image area is illuminated two times by quenching the charges in the non-image area, although there is no problem when the pressure plate is opened.

Since light fatigue of the photoconductor causes increase of the residual potential on the photoconductor, it is not preferable that the same portion of the photoconductor is exposed two times for such quenching of the unnecessary charges. Particularly in case copies are made from a large original document after repeated copying from a small original document, the surface potential in the preceding image area and that in the preceding non-image area become different, which causes an uneven image density in making copies from the large original.

SUMMARY OF THE INVENTION

It is therefore a primary object of the invention to provide an electrophotographic copying apparatus capable of quenching the unnecessary charges in the non-image area on the photoconductor prior to development, by eliminating the above-mentioned shortcomings of the conventional quenching systems.

Another object of the invention is to provide an electrophotographic copying apparatus capable of obviating background in the copies made from a large original after making copies from a small original repeatedly.

In one embodiment of an electrophotographic copying machine according to the invention, the electrophotographic copying machine is provided with a quenching apparatus capable of quenching the unnecessary charges in a non-image area of a photoconductor prior to development when a pressure plate for holding the original in close contact with a contact glass of the copying machine is opened. In another embodiment of an electrophotographic copying machine according to the invention, the quenching apparatus is capable of quenching the unnecessary charges in the non-image area of the photoconductor in accordance with the size of a transfer sheet. In a further embodiment of the invention, a copy size reduction exposure system is provided and the quenching apparatus is capable of quenching the unnecessary charges on the photoconductor in accordance with a selected copy reduction ratio or the size of a selected transfer sheet.

According to the present invention, in accordance with the position of the pressure plate, namely the closed position or half or completely opened position, the quenching of the unnecessary charges in the area outside the image area can be performed without obviating the double exposure the non-image area by controlling the quenching apparatus, so that light fatigue of the photoconductor and the unnecessary deposition of toner on the photoconductor can be obviated.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
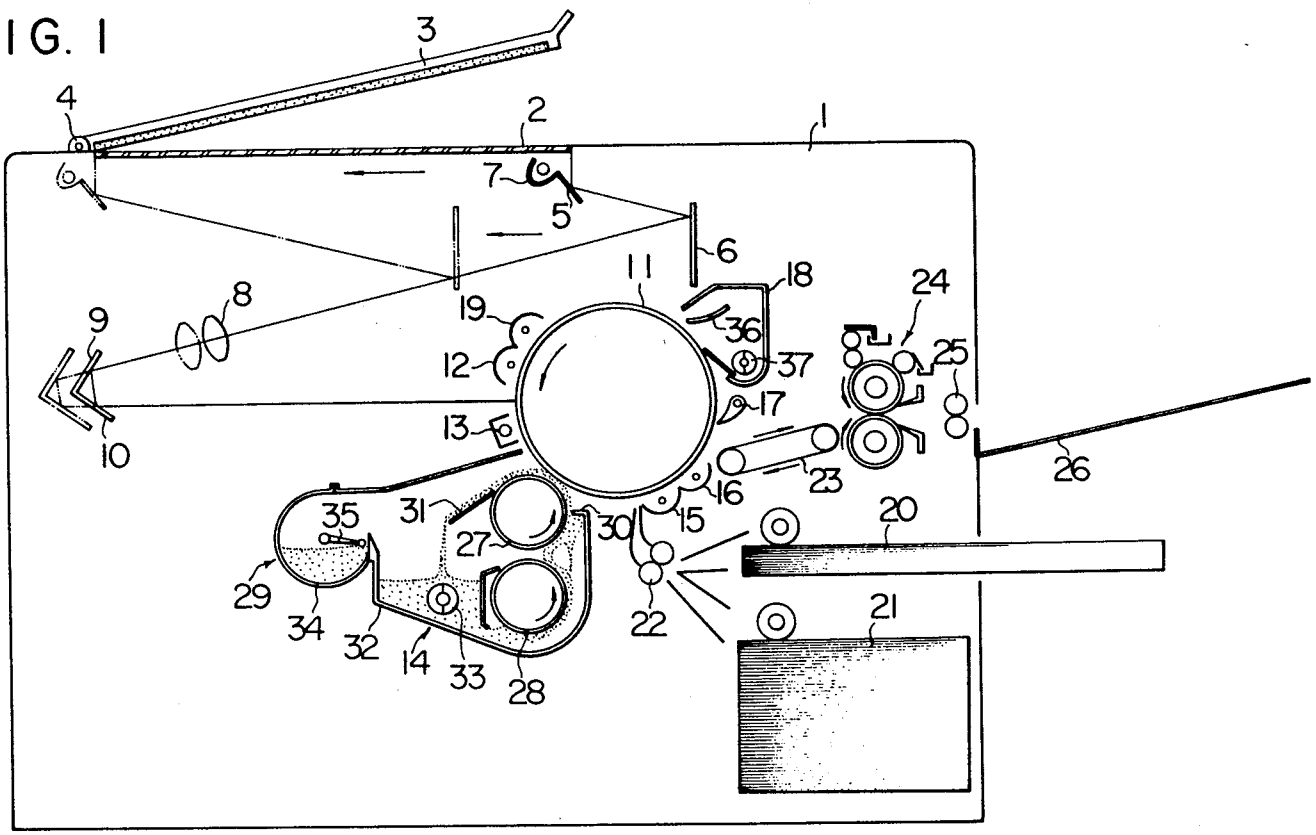
FIG. 1 is a schematic sectional view of an embodiment of an electrophotographic copying apparatus according to the present invention.

Referring to FIG. 1, there is schematically shown an embodiment of an electrophotographic coping machine according to the invention. On an upper portion of the body 1 of the electrophotographic copying machine, there is disposed a contact glass 2 for placing an original thereon. On the contact glass 2, there is disposed a pressure plate 3 for bringing the original into close contact with the contact glass 2. One edge portion of the pressure plate 3 is rotatably attached to a shaft 4 so that the pressure plate 3 can be pivoted away from the contact glass 2. A portion of the pressure plate 3 which directly contacts the contact glass 2, is lined with a light reflecting material which is capable of irregular reflection and is white or similar in color. Suitable material for this is silicone rubber and a synthetic paper consisting essentially of polypropylene. It is also important that the contact surface of the pressure plate is hardly smeared. Under the contact glass 2, there are disposed a first movable reflector 5 and a second movable reflector 6, which are moved parallel to the contact glass 2 at the speed ratio of 2:1, respectively. Also disposed under glass 2 is a lamp 7 which is moved together with the first movable reflector 5 and which illuminates the original document placed on the contact glass 2, a through-lens 8, and a slit exposure optical system comprising a third reflector 9 and a fourth reflector 10. Normally, the first and second movable reflectors 5 and 6, stand by in their respective home positions as indicated by solid lines. When the first and second movable reflectors 5 and 6 move in the direction of the respective arrows, exposure scanning is performed and, as soon as they reach the positions as indicated by the dash-dot-dot lines, they are returned to their respective home positions at a higher speed than the speeds at which they are moved in the direction of the arrows. A light image of the original illuminated by the lamp 7 is thus projected on a photoconductor drum 11 which is rotated in the direction of the arrow, by the first and second movable reflectors 5 and 6, the through-lens 8, the third reflector 9 and the fourth reflector 10. In case of equal size copying, the peripheral speed of the photoconductor drum 11 and the speed of the first movable reflector 5 are the same and constant at $V_O$. The above-mentioned slit optical exposure system is capable of a reduction exposure. In this case, the through-lens 8 and the third and fourth movable reflectors 9 and 10 are moved to their respective positions as indicated by the dash-dot-dot lines and, at the same time, the first and second movable reflectors 5 and 6 are controlled so as to increase their speeds to 1/m of their original speeds in accordance with a selected reduction ratio m ($m<1$).

Inorganic photoconductors such as selenium, zinc oxide, cadmium sulfide and organic photoconductors can be employed as the photoconductors for the photoconductor drum 11. Around the photoconductor drum 11, there are arranged a charging apparatus 12, a first quenching apparatus 13, a development apparatus 14, an image transfer apparatus 15, a charge quenching sheet separation apparatus 16, an auxiliary sheet separation apparatus 17, a cleaning apparatus 18 and a second quenching apparatus 19 in this order. Transfer sheets are stocked in a first sheet feed apparatus or means 20 and in a second sheet feed apparatus or means 21. Between the photoconductor drum 11 and the first and second sheet feed apparatuses 20 and 21, there is disposed a register roller 22. In a transfer sheet transportation path after the quenching sheet separation apparatus 16, there are disposed a sheet transportation belt 23, a thermal image fixing apparatus 24, a sheet discharge roller 25 and a sheet discharge tray 26.

The photoconductor drum 11 is electrically charged uniformly by the charging apparatus 12 comprising a corona charger and is then exposed by the slit optical exposure system. The unnecessary charges outside an image area on the surface of the photoconductor drum 11 are quenched by a quenching lamp of the quenching apparatus 13 and the photoconductor drum 11 is then passed over the development apparatus 14. The development apparatus 14 comprises a development roller 27, a developer feed roller 28 and a toner replenishing apparatus 29. Each of the development roller 27 and the developer feed roller 28 comprises a non-magnetic sleeve which is rotated counterclockwise and plural magnets disposed inside the non-magnetic sleeve. A two-component type developer consisting of toner and carrier is magnetically attracted to the developer feed roller 28 and is then transported to the development roller 27. The developer transferred to the development roller 27 is regulated by a doctor plate 30 prior to development so that the developer layer with an appropriate height of the crest of the developer is formed on the development roller. The developer which is on the development roller is brought into contact with the surface of the photoconductor drum 11 so that an electrostatic image formed on the photoconductor drum 11 is developed. The developer which has passed through the development section is removed from the surface of the development roller 27 by a scraping plate 31 and is then returned to a developer container 32. In the developer container 32, there is disposed a stirring blade 33 having a part or the whole thereof buried in the developer in the developer container 32. The stirring blade 33 serves to make the toner concentration in the developer uniform by stirring the developer as well as to charge the toner triboelectrically through the carrier particles. Referring to FIG. 1, the toner replenishing apparatus 29, disposed on the left side of the developer container 32, comprises a cylindrical container 34 with an opening for replenishing the toner therethrough. Inside the cylindrical container 34, there is disposed a toner replenishment member 35 which comprises arms capable of rotating about a shaft and coil springs stretched between the top portions of the arms. When a toner concentration detecting apparatus (not shown) detects that the toner concentration in the developer container is below a predetermined concentration, the toner replenishment member 35 is rotated clockwise about the shaft, so that the toner is fed into the developer container 32 through the opening.

The developed toner image on the drum 11 is brought into close contact with a transfer sheet which is fed from a preselected one of the sheet feed apparatus, that is, either the first or the second sheet feed apparatuses 20 and 21. The feeding is done in synchronization with the register roller 22.

The first sheet feed apparatus 20 is for feeding the transfer sheets which are not so frequently used in comparison with the transfer sheets stocked in the second sheet feed apparatus 21. The first sheet feed apparatus 20 is of a cassette sheet feed type while the second sheet feed apparatus 21 is of sheet feed base elevation type. Of course, it is possible to hold the same size transfer sheets in both the first and second sheet feed apparatuses 20 and 21. After the transfer sheet is brought into pressure contact with the photoconductor drum 11, toner is electrostatically transferred to the transfer sheet by the image transfer apparatus 15 comprising a corona discharger with the same polarity as that of the charging apparatus 12. Right behind or downstream of the image transfer apparatus 15, there is disposed the charge quenching sheet separation apparatus 16. The charge quenching sheet separation apparatus 16 serves to quench or remove the charges applied to the back side of each transfer sheet by the image transfer apparatus 15 and reduce the electrostatic attraction between the transfer sheet and the photoconductor drum 11, causing the transfer sheet to separate from the photoconductor drum 11 by the elasticity and weight of the sheet. However, in case the quenching effect of the sheet separation apparatus 16 is excessive, part of the toner image that has been transferred to the transfer sheet is moved back to the photoconductor drum 11, resulting in a reduction in the image transfer efficiency. Such a problem of the charge quenching sheet separation apparatus 16 can be eliminated by use of an AC current in which a DC voltage of a polarity opposite to that of the toner is superimposed onto an A.C. current. Alternatively, the charge quenching sheet separation apparatus 16 is operated in an appropriate timing with the movement of the transfer sheet, so that only the leading edge portion of the transfer sheet is discharged. The transfer sheet which is separated from the photoconductor drum 11 is transported to the thermal image fixing apparatus 24 by the sheet transportation belt 23. In case a transfer sheet with a weak elasticity is employed or the ambient humidity is significantly increased, occasionally the transfer sheet is not separated from the photoconductor drum 11 since the quenching effect of the charge quenching sheet separation apparatus 16 is lowered. Therefore, in order to obviate such a disadvantage, the auxiliary sheet separation apparatus 17 is provided and acts as a sheet separator which is disposed so as to be lightly in contact with the surface of the photoconductor 11. Normally, the auxiliary sheet separation apparatus 17 does not function as a sheet separation apparatus, but it is operated only when the charge quenching sheet separation apparatus 16 is not operated properly. Even if the charge quenching sheet separation apparatus 16 is not operated properly, it still quenches the charges on the transfer sheet. Therefore, the electrostatic attraction between the transfer sheet and the photoconductor drum 11 is reduced, so that it is unnecessary for the sheet separation function of the auxiliary sheet separation apparatus 17 to be as high as the ordinary sheet separation apparatus. Accordingly, there is no risk that the auxiliary sheet separation apparatus 17 may scratch the surface of the photoconductor drum 11. Furthermore, it is unnecessary for the sheet separator to be brought into or out of contact with the photoconductor drum 11 in synchronization with the movement of the transfer sheet. Therefore, a simple sheet separation apparatus can do for this purpose. In case an air buffer system is used as the auxiliary sheet separation system, a comparatively weak air jet does work. Therefore, scattering of the toner particles, from the developer or from the toner image bearing transfer sheet, can be obviated. By the sheet transportation belt 23, the transfer sheet is transported to the thermal image fixing apparatus 24, where the toner image is fixed to the transfer sheet. The thermal image fixing apparatus 24 comprises a pair of heat rollers. The transfer sheet is discharged onto the sheet discharge tray 26 by sheet discharge rollers 25. In the meantime, the toner remaining on the photoconductor drum 11 is removed by a cleaning blade 36. The toner thus removed is returned to the toner replenishing apparatus 29 by a toner transportation member 37 and by a toner transportation means (not shown), disposed between the cleaning apparatus 18 and the toner replenishing apparatus 29. Residual charges on the thus cleaned drum 11 are quenched by the second quenching apparatus 19 comprising an AC corona discharger. Thus, a first copying process is completed.

Figure 2:
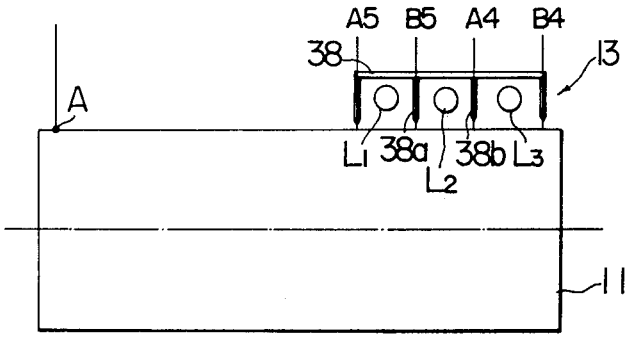
FIG. 2 is a schematic sectional view of a quenching apparatus to be employed in the present invention.

Referring to FIG. 2, there is schematically shown an embodiment of the quenching apparatus 13 according to the invention. The quenching apparatus 13 comprises a casing 38, partition walls **38*a* and 38*b* by which the casing 38 is divided into three compartments, and lamps L1, L2 and L3, each of which is disposed in one of the three compartments. The partition walls 38*a* and 38*b* are disposed in close proximity to the surface of the photoconductor drum 11 in accordance with the size of an image to be formed on the drum 11. In FIG. 2, an inner wall of the casing 38 is formed in a position corresponding to the A5 size measured from a reference position A on the drum 11. Likewise, the partition wall 38*a* is formed in a position corresponding to the B5 size, and partition wall 38*b* is formed in a position corresponding to the A4 size, and an outer wall of the casing 38 is formed in a position corresponding to the B4 size. Lighting of the lamps L1, L2 and L3 is controlled by a control circuit as will be explained. When the lamps L1, L2 and L3 are on, they give a sufficient exposure to the drum 11 to eliminate charges on the drum 11. In the present electrophotographic copying machine, a B4 size transfer sheet is fed with a longer side set as the leading edge. However, this is a matter of design of each copying machine and in accordance with each feeding manner, the quenching width of the quenching apparatus 13** can be adjusted appropriately.

Figure 3:
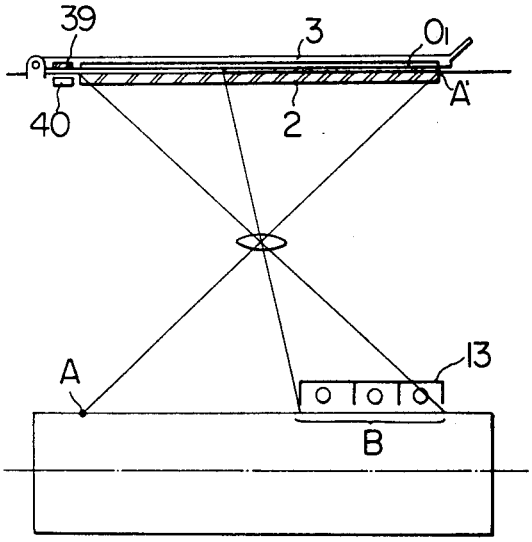
FIGS. 3 and 4 schematically show the principle of the invention.
Figure 4:
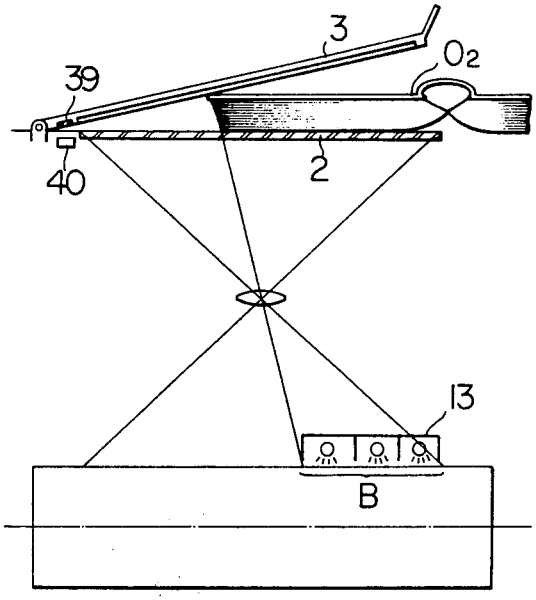

FIGS. 3 and 4 are now referred to for explaining the principle of the invention. Referring to FIG. 3, a sheet original $O_1$ of A5 size is placed on the contact glass 2 with one side edge in line with a reference portion A', so that copying is performed with the sheet original $O_1$ covered with the pressure plate 3. The pressure plate 3 is provided with a magnet 39, and on an upper portion of the copying machine 1 corresponding to the position of the magnet 39, there is provided a lead switch 40, which is capable of detecting that the pressure plate 3 is too opened to quench the charges on the photoconductor drum 11 by light reflected from an inner surface of the pressure plate 3. The operating position of the lead switch 40 can be determined experimentally. Instead of the above-mentioned magnetic detecting means, an optical detecting means and a micro switch can be employed as well. In case of FIG. 3, unnecessary charges on the photoconductor drum 11 in an area outside the image area, corresponding to an area B outside the original $O_1$, are quenched by light reflected from the inner side of the pressure plate 3. Therefore, operation of the quenching apparatus 13 is hindered. Thus, when the lead switch 40 detects that the pressure plate 3 is closed, the quenching apparatus 13 is made inoperative. However, when copies are made from a thicker original $O_2$ placed on the contact glass 2, the pressure plate 3 is not closed completely as shown in FIG. 4. In this case, light sufficient to quench the charges in an area B on the drum 11, corresponding to an area outside the original $O_2$, is not reflected from the inner side of the pressure plate 3. The originals $O_1$ and $O_2$ are of the same A5 size. Even when the pressure plate 3 is opened as shown in FIG. 4, a transfer sheet of a size corresponding to the size of the original is employed. Therefore, the quenching apparatus 13 is operated in accordance with the size of the transfer sheet. Since the lead switch 40 is positioned away from the magnet 39, the lead switch 40 can detect that the pressure plate 3 is opened as shown in FIG. 4. When a different size transfer sheet is used, the lighting of the lamps L1, L2 and L3 is controlled in accordance with the different size transfer sheet.

Figure 5:
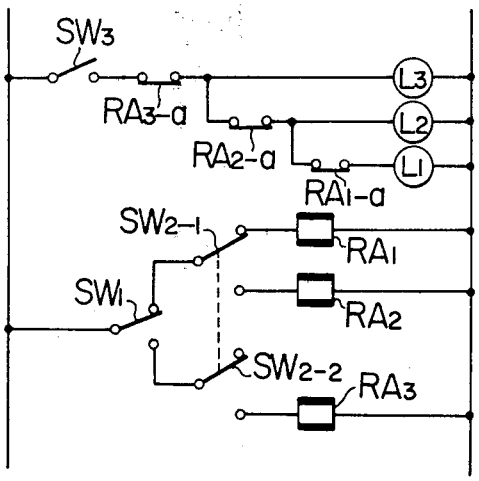
FIG. 5 shows an electric circuit for the quenching apparatus of FIG. 2.

Referring to FIG. 5, there is shown a circuit or control means for the quenching apparatus 13 of the invention. Relays RA1, RA2 and RA3 are connected in parallel with each other, and switches SW1, SW2-1 and SW2-2, each of which is operated in accordance with the size of each transfer sheet, are connected as shown in FIG. 5. The lamps L1, L2 and L3 are also connected in parallel with each other. The lamp L3 is connected in series with a normal close contact RA3-a of the relay RA3, and the lamp L2 is connected in series with a normal close contact RA2-*a* of the relay RA2 and with the normal close contact RA3-*a*, and the lamp L1 is connected in series with a normal close contact RA1-*a* of the relay RA1, the contact RA2-*a* and the contact RA3-*a*. Furthermore, the lamps L3, L2 and L1 are connected in series with the switch SW3 which is on when the pressure plate 3 is opened and which is off when the pressure plate 3 is closed. When the pressure plate 3 is closed, the switch SW3 is opened as shown in FIG. 5, so that the lamps L1, L2 and L3 are not lighted. When the pressure plate 3 is opened, the switch SW3 is closed, so that the lamps L1, L2 and L3 can be lighted. In the present embodiment, there are four choices A5, B5, A4 and B4 in the size of transfer sheet. In case of A5 size, the switch SW1 is off and the switch SW2 is on, and in case of B5 size, the switches SW1 and SW2 are both on, and in case of A4 size, the switch SW1 is on and the switch SW2 is off, and in case of B4 size, the switches SW1 and SW2 are both off. The size of the transfer sheet can be detected directly from the size of the transfer sheet in the sheet feed apparatus, or from the size of each cassette for the transfer sheet, or from a movable side plate for a sheet feed table or each cassette for the transfer sheet, or by feeding a signal indicating the size of the transfer sheet to the copying machine by the operator of the copying machine. When the pressure plate 3 is completely closed, the switch SW3 is opened irrespective of the size of the transfer sheet to be used, so that the lamps L1, L2 and L3 are not lighted. When copying is performed with the pressure plate 3 opened, employing an A5 size transfer sheet (the size of the original is the same as that of the transfer sheet), the relays RA1, RA2 and RA3 are not operated, and all the lamps L1, L2 and L3 are lighted, so that the area B on the photoconductor drum 11 is illuminated as shown in FIG. 4. When a B5 size transfer sheet is employed, the relay RA1 is actuated and the contact RA1-*a* is opened, so that the lamps L2 and L3 are lighted. When an A4 size transfer sheet is employed, the relay RA2 is actuated and the contact RA2-*a* is opened, so that only the lamp L3 is lighted. Furthermore, when a B4 size transfer sheet is employed, the relay RA3 is actuated and the relay RA3-*a* is opened, so that none of the lamps L1, L2 and L3 is lighted. Even when a different size transfer sheet is employed, the quenching apparatus 13 detects to what extent the pressure plate 3 is opened, so that unnecessary charges in the area outside the image area of the photoconductor drum 11 are quenched by a first quenching exposure.

Figure 6:
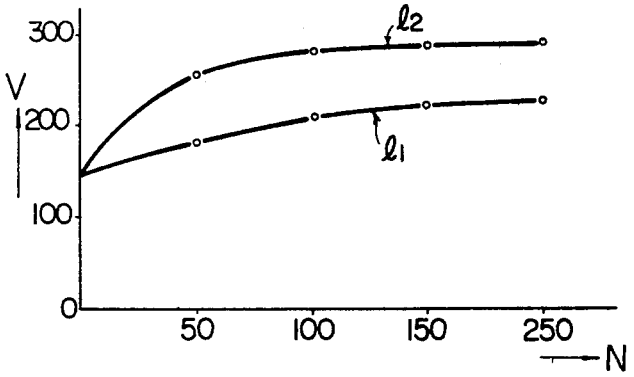
FIG. 6 is a graph showing the results of experiments indicating the effect of the quenching apparatus of FIG. 2 in comparison to a copying machine in which the quenching apparatus is not employed.

In FIG. 6, there are shown the results of an experiment for comparing the effect of quenching the charges in an area outside the image area of the drum 11 by closing the pressure plate 3 and the effect of a double quenching by operating the quenching apparatus 13. In FIG. 6, the data are plotted, with the number of repeated copying (N) as abscissa and the residual potential (V) on a photoconductor as ordinate. As the photoconductor, a selenium-tellurium photoconductor was used. A curve $1_1$ indicates the residual potential on the photoconductor when the quenching apparatus 13 was not operated, while a curve $1_2$ indicates the residual potential in the case of a double quenching by use of the quenching apparatus 13. The results show that there is a difference of about 70 V in the residual potential between the two, and in the case of the double exposure, light fatigue of the photoconductor was found considerable. Furthermore, when an image was formed in the double exposed area for copying a larger original after repetition of the double exposure, light fatigue of the photoconductor was observed and a considerable background appeared in the double exposed area due to the increased residual surface potential on the photoconductor. However, in the case where the quenching apparatus was not operated, such light fatigue of the photoconductor was not observed.

Figure 7:
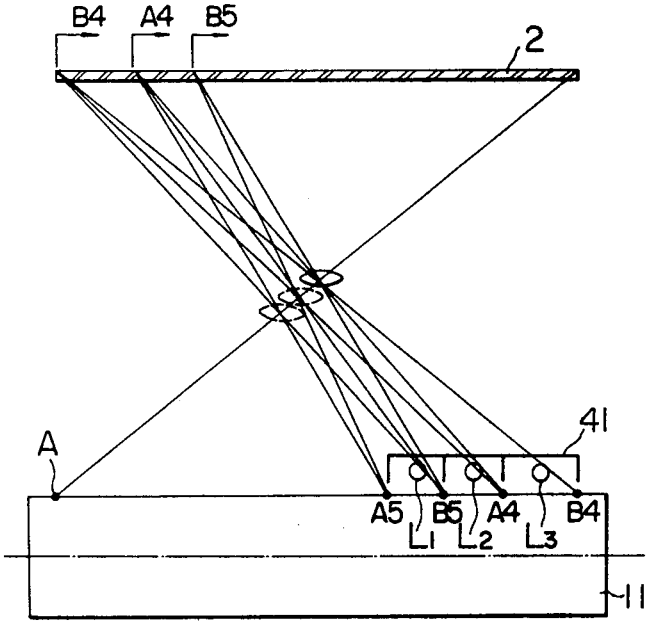
FIG. 7 shows the principle of another embodiment of the invention.

FIG. 7 shows a principle of applying the present invention to a copying machine capable of reduction exposure. When reduction exposure is performed, a quenching method which is different from that in case of the equal size copying is necessary. To be more specific, in case of reduction exposure, the contact glass 2 is projected on the photoconductor drum 11, with a predetermined reduction as a whole. Therefore, light reflected from the pressure plate 3 does not come to any area outside the image area of the drum 11. In case the original is smaller than a maximum size original that can be employed, there may be an image area, an area outside the image area, illuminated by light reflected from the pressure plate 3, and a non-illuminated area outside the image area on the drum 11. Therefore, in the embodiment of the present invention, one quenching exposure is performed in the area outside the image area even in the case of such reduction exposure. The operation of an electrophotographic copying machine having an exposure optical system capable of reduction copying can be explained, assuming that an A5 size transfer sheet is the minimum size transfer sheet. Of course, the present invention is not limited to the above. A quenching apparatus 41 employed here has the same construction as that of the previously mentioned quenching apparatus 13. The only difference between them is the control of the lamps. First, a B4 size original, which is the maximum size original, is placed on the contact glass 2 and reduced to A4 size by a first reduction ratio (from B size to A size: reduction ratio is about 0.82). At this time, the lamp L3 is lighted so as to quench the area outside the image area even when the pressure plate 3 is opened. When the original is reduced to B5 size by a second reduction ratio (from B size to B size smaller by one rank or from A size to A size smaller by one rank: reduction ratio is about 0.71). In this case, irrespective of the position of the pressure plate 3, the lamps L2 and L3 are lighted. Therefore, the quenching lamps can be controlled under an AND condition of a selected reduction ratio and a selected transfer sheet size. As to an A4 size original, the lamps are inoperative when equal size copying is performed with the pressure plate 3 closed. When the A4 size original is converted to B5 size original by the first reduction ratio, images are formed in the area from the reference portion A to the position of B5 size on the photoconductor drum 11. Since light reflected from the pressure plate 3 reaches the area under the lamp L2, it is enough to light only the lamp L3. In case the pressure plate 3 is opened, the lamps L2 and L3 have to be lighted. In case the A4 size original is converted to A5 size, the lamps L2 and L3 are lit when the pressure plate 3 is closed, and when the pressure plate 3 is opened, all the lamps L1, L2, L3 have to be lit. Finally, in case a B5 size original is converted to A5 size by the first reduction ratio, only the lamp L3 is lit when the pressure plate 3 is closed, and when the pressure plate 3 is opened, all the lamps L1, L2, L3 have to be lit.

In other words, when the first reduction ratio is chosen with the pressure plate 3 closed, the lamp L3 has to be lit, and when the second reduction ratio is chosen with the pressure plate 3 closed, the lamps L2, L3 have to be lit. In the case where the pressure plate 3 is opened, when the original is of A4 size, the lamp L3 has to be lit, and when the original is of B5 size, the lamps L1, L2, L3 are lit. In accordance with the opening or closing position of the pressure plate 3, the lamps L1, L2, L3 are controlled with a priority of either the reduction ratio or the size of the transfer sheet.

In the above-mentioned embodiment, the quenching is performed in the direction normal to the movement of the photoconductor drum 11. However, the quenching apparatus can be provided so as to move in the same direction as that of the drum 11 in synchronism with the movement of the drum 11 for quenching the front and back portions of the image area.

Figure 8:
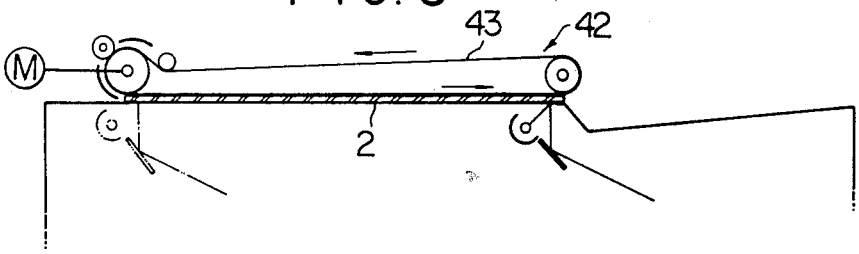
FIG. 8 is a partial sectional view of a further embodiment of the invention.

Furthermore, in the above-mentioned embodiment, the pressure plate 3 is disclosed as an original holding member. However, a belt apparatus for automatic sheet feeding can also be employed as the original holding member. In a belt apparatus 42 for automatic sheet feeding as shown in FIG. 8, a belt 43 which is rotated in the direction of the arrow on the contact glass 2 has a white surface, and the sheet original is passed over the contact glass 2 by the friction between the sheet original and the belt 43. When plural copies are obtained from one sheet original, the sheet original is inserted between the belt 43 and the contact glass 2 and is then stopped at a predetermined position on the contact glass 2, and is illuminated by moving an optical system. In this, the quenching control is the same as when the pressure plate 3, in the previously mentioned embodiment is closed. In case of a copy mode in which the illumination of the sheet original is performed while the sheet original is moved by the belt apparatus 42, with the optical system stopped at a predetermined position of the contact glass 2, the quenching control is the same as mentioned above. When reduction copying is additionally performed, the feeding speed of the original has to be adjusted in accordance with the reduction ratio. However, the control of the quenching lamps is performed in accordance with a selected reduction ratio. This control is the same as the previously mentioned control. As the photoconductor, a belt-shaped photoconductor can be used instead of the drum-shaped photoconductor. The present invention can be applied to a copying process employing a three-layered photoconductor having a transparent dielectric layer at the surface. Of course, the invention can be applied to a copying process employing a slit exposure system and that employing an overall exposure system. Furthermore, the invention can be applied to a copying machine of wet type development as well.

While specific embodiments of the invention have been shown and described in detail to illustrate the application of the principles of the invention, it will be understood that the invention may be embodied otherwise without departing from such principles.

What is claimed is:

1. In an electrophotographic copying machine having a movable photoconductor, a contact glass adapted for supporting an original spaced from the photoconductor, imaging means between the contact glass and the photoconductor for focusing an image of an original document to be copied onto the photoconductor, a developing station in the path of motion of the photoconductor for developing the image, and a pressure plate movable toward and away from the contact glass for holding an original document to be copied, having a light-reflecting surface on a side thereof facing the contact glass, the improvement comprising:

detection means associated with the pressure plate for sensing the position of the pressure plate with respect to the contact glass;

quenching means facing the photoconductor at a position upstream of the developing station in the direction of movement of the photoconductor; and control means connected between said detection means and said quenching means for activating said quenching means when the pressure plate is in a position away from the contact glass.

2. The improvement of claim 1 wherein said quenching means comprises at least one lamp for illuminating a portion of said photoconductor, said control means comprising a switch connected to said lamp for lighting said lamp when the pressure plate is at a location away from the contact glass and for extinguishing the lamp when the pressure plate is against the contact glass.

* * * * *